US007970144B1

(12) United States Patent
Avendano et al.

(10) Patent No.: US 7,970,144 B1
(45) Date of Patent: Jun. 28, 2011

(54) EXTRACTING AND MODIFYING A PANNED SOURCE FOR ENHANCEMENT AND UPMIX OF AUDIO SIGNALS

(75) Inventors: Carlos Avendano, Campbell, CA (US); Michael Goodwin, Scotts Valley, CA (US); Ramkumar Sridharan, Capitola, CA (US); Martin Wolters, Nuremberg (DE); Jean-Marc Jot, Aptos, CA (US)

(73) Assignee: Creative Technology Ltd, Singapore (SG)

( * ) Notice: Subject to any disclaimer, the term of this patent is extended or adjusted under 35 U.S.C. 154(b) by 963 days.

(21) Appl. No.: 10/738,607

(22) Filed: Dec. 17, 2003

(51) Int. Cl.
*H04R 5/00* (2006.01)

(52) U.S. Cl. ..... 381/1; 381/17; 381/61; 381/27; 381/97

(58) Field of Classification Search ..... 381/119, 381/61, 63, 99, 10, 17–18, 19, 1–2, 98, 103, 381/27, 303, 306–307, 309–310; 315/291
See application file for complete search history.

(56) References Cited

U.S. PATENT DOCUMENTS

| | | | | |
|---|---|---|---|---|
| 3,697,692 | A | 10/1972 | Hafler | |
| 4,024,344 | A | 5/1977 | Dolby et al. | |
| 5,666,424 | A | 9/1997 | Fosgate et al. | |
| 5,671,287 | A | 9/1997 | Gerzon | |
| 5,872,851 | A | 2/1999 | Petroff | |
| 5,878,389 | A | 3/1999 | Hermansky et al. | |
| 5,886,276 | A | 3/1999 | Levine et al. | |
| 5,890,125 | A | 3/1999 | Davis et al. | |
| 5,909,663 | A | 6/1999 | Iijima et al. | |
| 5,953,696 | A | 9/1999 | Nishiguchi et al. | |
| 6,011,851 | A * | 1/2000 | Connor et al. | 381/17 |
| 6,021,386 | A | 2/2000 | Davis et al. | |
| 6,098,038 | A | 8/2000 | Hermansky et al. | |
| 6,285,767 | B1 | 9/2001 | Klayman | |
| 6,405,163 | B1 * | 6/2002 | Laroche | 704/205 |
| 6,430,528 | B1 | 8/2002 | Jourjine et al. | |
| 6,449,368 | B1 | 9/2002 | Davis et al. | |
| 6,473,733 | B1 | 10/2002 | McArthur et al. | |
| 6,570,991 | B1 | 5/2003 | Scheirer et al. | |
| 6,766,028 | B1 * | 7/2004 | Dickens | 381/310 |
| 6,792,118 | B2 | 9/2004 | Watts | |
| 6,917,686 | B2 | 7/2005 | Jot et al. | |
| 6,934,395 | B2 * | 8/2005 | Ito | 381/23 |
| 6,999,590 | B2 | 2/2006 | Chen | |
| 7,006,636 | B2 | 2/2006 | Baumgarte et al. | |
| 7,039,204 | B2 * | 5/2006 | Baumgarte | 381/119 |

(Continued)

FOREIGN PATENT DOCUMENTS

WO WO/01/24577 4/2001

OTHER PUBLICATIONS

Carlos Avendano and Jean-Marc Jot: *Ambience Extraction and Synthesis from Stereo Signals for Multi-Channel Audio Up-Mix*; vol. II—1957-1960: © 2002 IEEE.

(Continued)

*Primary Examiner* — Devona E Faulk
*Assistant Examiner* — Disler Paul

(57) ABSTRACT

Modifying a panned source in an audio signal comprising a plurality of channel signals is disclosed. Portions associated with the panned source are identified in at least selected ones of the channel signals. The identified portions are modified based at least in part on a user input.

31 Claims, 13 Drawing Sheets

U.S. PATENT DOCUMENTS

| | | | | |
|---|---|---|---|---|
| 7,076,071 | B2 | 7/2006 | Katz | |
| 7,257,231 | B1 | 8/2007 | Avendano et al. | |
| 7,272,556 | B1 * | 9/2007 | Aguilar et al. | 704/230 |
| 7,277,550 | B1 | 10/2007 | Avendano et al. | |
| 7,353,169 | B1 | 4/2008 | Goodwin et al. | |
| 7,412,380 | B1 | 8/2008 | Avendano et al. | |
| 7,567,845 | B1 | 7/2009 | Avendano et al. | |
| 2002/0054685 | A1 * | 5/2002 | Avendano et al. | 381/66 |
| 2002/0094795 | A1 | 7/2002 | Mitzlaff | |
| 2002/0136412 | A1 | 9/2002 | Sugimoto | |
| 2002/0154783 | A1 | 10/2002 | Fincham | |
| 2003/0026441 | A1 | 2/2003 | Faller | |
| 2003/0174845 | A1 * | 9/2003 | Hagiwara | 381/17 |
| 2003/0233158 | A1 * | 12/2003 | Aiso et al. | 700/94 |
| 2004/0044525 | A1 | 3/2004 | Vinton et al. | |
| 2004/0122662 | A1 | 6/2004 | Crockett | |
| 2004/0196988 | A1 * | 10/2004 | Moulios et al. | 381/119 |
| 2004/0212320 | A1 * | 10/2004 | Dowling et al. | 315/291 |
| 2007/0041592 | A1 | 2/2007 | Avendano et al. | |

OTHER PUBLICATIONS

Jean-Marc Jot and Carlos Avendano: *Spatial Enhancement of Audio Recordings*; AES 23rd International Conference, Copenhagen, Denmark, May 23-25, 2003.

Carlos Avendano: *Frequency-Domain Source Identification and Manipulation in Stereo Mixes for Enhancement, Suppression and Re-Panning Applications*; 2003 IEEE Workshop on Applications of Signed Processing to Audio and Acoustics; Oct. 19-22, 2003, New Paltz, NY.

Eric Lindemann: *Two Microphone Nonlinear Frequency Domain Beamformer for Hearing Aid Noise Reduction*; Application of Signal Processing to Audio and Acoustics, Oct. 15-18, 1995, pp. 24-27. New Paltz, NY.

U.S. Appl. No. 10/163,158, filed Jun. 4, 2002, Avendano et al.

U.S. Appl. No. 10/163,168, filed Jun. 4, 2002, Avendano et al.

Allen, et al, "Multimicrophone signal-processing technique to remove room reverberation from speech signals" J. Accoust. Soc. Am., vol. 62, No. 4, Oct. 1977, p. 912-915.

Baumgarte, Frank , et al, "Estimation of Auditory Spatial Cues for Binaural Cue Coding", IEEE Int'l. Conf. On Acoustics, Speech and Signal Processing, May 2000.

Begault, Durand R., "3-D Sound for Virtual Reality and Multimedia", A P Professional, p. 226-229.

Blauert, Jens, "Spatial Hearing the Psychophysics of Human Sound Localization", The MIT Press, pp. 238-257.

Dressler, Roger, "Dolby Surround Pro Logic II Decoder Principles of Operation", Dolby Laboratories, Inc., 100 Potrero Ave., San Francisco, CA 94103.

Faller, Christof, et al, "Binaural Cue Coding: A Novel and Efficient Representation of Spatial Audio", IEEE Int'l. Conf. On Acoustics, Speech & Signal Processing, May 2002.

Gerzon, Michael A., "Optimum Reproduction Matrices for Multispeaker Stereo", J. Audio Eng. Soc. vol. 40, No. 78, Jul. Aug. 1992.

Holman, Tomlinson, "Mixing the Sound" Surround Magazine, p. 35-37, Jun. 2001.

Jot, Jean-Marc, et al, "A Comparative Study of 3-D Audio Encoding and Rendering Techniques", AES 16th Int'l. Conf. On Spatial Sound Reproduction, Rovaniemi, Finland 1999.

Kyriakakis, C., et al, "Virtual Microphone for Multichannel Audio Applications" In Proc. IEEE ICME 2000, vol. 1, pp. 11-14, Aug. 2000.

Miles, Michael T., "An Optimum Linear-Matrix Stereo Imaging System." AES 101 Convention, 1996, preprint 4364 (J-4).

Pulkki, Ville, et al. "Localization of Amplitude-Panned Virtual Sources I: Stereophonic Panning", J. Audio Eng. Soc., vol. 49, No. 9, Sep. 2002.

Rumsey, Francis, "Controlled Subjective Assessments of Two-to-Five-Channel Surround Sound Processing Algorithms", J. Audio Eng. Soc., vol. 47, No. 7/8, Jul./Aug. 1999.

Schoeder, Manfred R., "An Artificial Stereophonic Effect Obtained from a Single Audio Signal", Journal of the Audio Engineering Society, vol. 6, pp. 74-79, Apr. 1958.

Jourjine et al., Blind Separation of Disjoint Orthogonal Signals: Demixing N Sources from 2 Mixtures, IEEE International Conference on Acoustics, Speech and Signal Processing, vol. 5, pp. 2985-2988, Apr. 2000.

Steven F. Boll. Suppression of Acoustic Noise in Speech Using Spectral Subtraction. IEEE Transactions on Acoustics, Speech and Signal Processing. Apr. 1979. pp. 113-120. vol. ASSP-27, No. 2.

Bosi, Marina, et al., ISO/IEC MPEG-2 advanced audio coding, AES 101, Los Angeles, Nov. 1996, J. Audio Eng. Soc., vol. 45, No. 10, Oct. 1997.

Duxbury, Chris, et al, "Separation of Transient Information in Musical Audio Using Multiresolution Analysis Techniques", Proceedings of the COST G-6 Conference on Digital Audio Effects (DAFX-01) Dec. 2001.

Levine, Scott N., et al. "Improvements to the Switched Parametric and Transform Audio Coder", Proceedings of the IEEE Workshop on Applications of Signal Processing to Audio and Acoustics, Oct. 1999, pp. 43-46.

Pan, Davis, "A Tutorial on MPEG/Audio Compression" IEEE MultiMedia, Summer 1995.

Quatieri, T.F., et al, "Speech Enhancement Based on Auditory Spectral Change", Proceedings of the IEEE Workshop on Applications of Signal Processing to Audio and Acoustics, Oct. 1999, pp. 43-46.

Baumgarte et al., Estimation of Auditory Spatial Cues for Binaural Cue Coding, IEEE International Conference on Acoustics, Speech and Signal Processing, May 2002.

* cited by examiner

EXTRACTING AND MODIFYING A PANNED SOURCE FOR ENHANCEMENT AND UPMIX OF AUDIO SIGNALS

INCORPORATION BY REFERENCE

U.S. patent application Ser. No. 10/163,158, entitled Ambience Generation for Stereo Signals, filed Jun. 4, 2002, now U.S. Pat. No. 7,567,845 B1, is incorporated herein by reference for all purposes. U.S. patent application Ser. No. 10/163,168, entitled Stream Segregation for Stereo Signals, filed Jun. 4, 2002, now U.S. Pat. No. 7,257,231, is incorporated herein by reference for all purposes.

U.S. patent application Ser. No. 10/738,361, entitled Ambience Extraction and Modification for Enhancement and Upmix of Audio Signals, filed Dec. 17, 2003, now U.S. Pat. No. 7,412,380, is incorporated herein by reference for all purposes.

FIELD OF THE INVENTION

The present invention relates generally to digital signal processing. More specifically, extracting and modifying a panned source for enhancement and upmix of audio signals is disclosed.

BACKGROUND OF THE INVENTION

Stereo recordings and other multichannel audio signals may comprise one or more components designed to give a listener the sense that a particular source of sound is positioned at a particular location relative to the listener. For example, in the case of a stereo recording made in a studio, the recording engineer might mix the left and right signal so as to give the listener a sense that a particular source recorded in isolation of other sources is located at some angle off the axis between the left and right speakers. The term "panning" is often used to describe such techniques, and a source panned to a particular location relative to a listener located at a certain spot equidistant from both the left and right speakers (and/or other or different speakers in the case of audio signals other than stereo signals) will be referred to herein as a "panned source".

A special case of a panned source is a source panned to the center. Vocal components of music recordings, for example, typically are center-panned, to give a listener a sense that the singer or speaker is located in the center of a virtual stage defined by the left and right speakers. Other sources might be panned to other locations to the left or right of center.

The level of a panned source relative to the overall signal is determined in the case of a studio recording by a sound engineer and in the case of a live recording by such factors as the location of each source in relation to the microphones used to make the recording, the equipment used, the characteristics of the venue, etc. An individual listener, however, may prefer that a particular panned source have a level relative to the rest of the audio signal that is different (higher or lower) than the level it has in the original audio signal. Therefore, there is a need for a way to allow a user to control the level of a panned source in an audio signal.

As noted above, vocal components typically are panned to the center. However, other sources, e.g., percussion instruments, also typically may be panned to the center. A listener may wish to modify (e.g., enhance or suppress) a center-panned vocal component without modifying other center-panned sources at the same time. Therefore, there is a need for a way to isolate a center-panned vocal component from other sources, such as percussion instruments, that may be panned to the center.

Finally, listeners with surround sound systems of various configurations (e.g., five speaker, seven speaker, etc.) may desire a way to "upmix" a received audio signal, if necessary, to make use of the full capabilities of their playback system. For example, a user may wish to generate an audio signal for a playback channel by extracting a panned source from one or more channels of an input audio signal and providing the extracted component to the playback channel. A user might want to extract a center-panned vocal component, for example, and provide the vocal component as a generated signal for the center playback channel. Some users may wish to generate such a signal regardless of whether the received audio signal has a corresponding channel. In such embodiments, listeners further need a way to control the level of the panned source signal generated for such channels in accordance with their individual preferences.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION

Figure 1A:
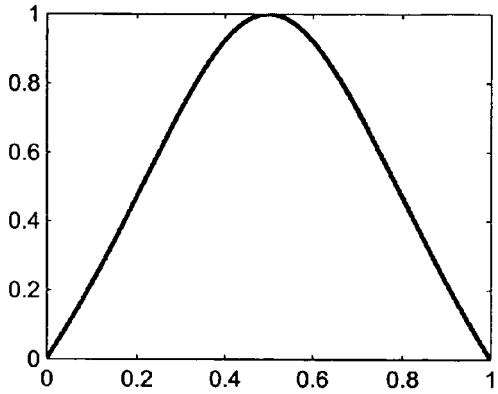
FIG. 1A is a plot of this panning function as a function of the panning coefficient $\alpha$ in an embodiment in which $\beta=1-\alpha$.

It should be appreciated that the present invention can be implemented in numerous ways, including as a process, an apparatus, a system, or a computer readable medium such as a computer readable storage medium or a computer network wherein program instructions are sent over optical or electronic communication links. It should be noted that the order of the steps of disclosed processes may be altered within the scope of the invention.

A detailed description of one or more preferred embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail so that the present invention is not unnecessarily obscured.

Extracting and modifying a panned source for enhancement and upmix of audio signals is disclosed. In one embodiment, a panned source is identified in an audio signal and portions of the audio signal associated with the panned source are modified, such as by enhancing or suppressing such portions relative to other portions of the signal. In one embodiment, a panned source is identified and extracted, and a user-controlled modification is applied to the panned source prior to routing the modified panned source as a generated signal for an appropriate channel of a multichannel playback system, such as a surround sound system. In one embodiment, a center-panned vocal component is distinguished from certain other sources that may also be panned to the center by incorporating transient analysis. These and other embodiments are described more fully below.

As used herein, the term "audio signal" comprises any set of audio data susceptible to being rendered via a playback system, including without limitation a signal received via a network or wireless communication, a live feed received in real-time from a local and/or remote location, and/or a signal generated by a playback system or component by reading data stored on a storage device, such as a sound recording stored on a compact disc, magnetic tape, flash or other memory device, or any type of media that may be used to store audio data, and may include without limitation a mono, stereo, or multichannel audio signal including any number of channel signals.

1. Identifying and Extracting a Panned Source

In this section we describe a metric used to compare two complementary channels of a multichannel audio signal, such as the left and right channels of a stereo signal. This metric allows us to estimate the panning coefficients, via a panning index, of the different sources in the stereo mix. Let us start by defining our signal model. We assume that the stereo recording consists of multiple sources that are panned in amplitude. The stereo signal with $N_s$ amplitude-panned sources can be written as $$S_L(t)=\Sigma_i\beta_i S_i(t) \text{ and } S_R(t)=\Sigma_i\alpha_i S_i(t), \text{ for } i=1, \ldots, N_s. \quad (1)$$

where $\alpha_i$ are the panning coefficients and $\beta_i$ are factors derived from the panning coefficients. In one embodiment, $\beta_i=(1-\alpha_i^2)^{1/2}$, which preserves the energy of each source. In one embodiment, $\beta_i=1-\alpha_i$. Since the time-domain signals corresponding to the sources overlap in amplitude, it is very difficult (if not impossible) to determine in the time domain which portions of the signal correspond to a given source, not to mention the difficulty in estimating the corresponding panning coefficients. However, if we transform the signals using the short-time Fourier transform (STFT), we can look at the signals in different frequencies at different instants in time thus making the task of estimating the panning coefficients less difficult.

In one embodiment, the left and right channel signals are compared in the STFT domain using an instantaneous correlation, or similarity measure. The proposed short-time similarity can be written as $$\psi(m,k)=2|S_L(m,k)S_R^*(m,k)|[|S_L(m,k)|^2+|S_R(m,k)|^2]^{-1}, \quad (2)$$

we also define two partial similarity functions that will become useful later on:

$$\psi_L(m,k)=|S_L(m,k)S_R^*(m,k)||S_L(m,k)|^{-2} \quad (2a)$$

$$\psi_R(m,k)=|S_R(m,k)S_L^*(m,k)||S_R(m,k)|^{-2} \quad (2b)$$

In other embodiments, other similarity functions may be used.

The similarity in (2) has the following important properties. If we assume that only one amplitude-panned source is present, then the function will have a value proportional to the panning coefficient at those time/frequency regions where the source has some energy, i.e.

$$\Psi(m,k) = 2|\alpha S(m,k)\beta S^*(m,k)|[|\alpha S(m,k)|^2+|\beta S(m,k)|^2]^{-1}, = 2\alpha\beta(\alpha^2+\beta^2)^{-1}.$$

If the source is center-panned ($\alpha=\beta$), then the function will attain its maximum value of one, and if the source is panned completely to one side, the function will attain its minimum value of zero. In other words, the function is bounded. Given its properties, this function allows us to identify and separate time-frequency regions with similar panning coefficients. For example, by segregating time-frequency bins with a given similarity value we can generate a new short-time transform signal, which upon reconstruction will produce a time-domain signal with an individual source (if only one source was panned in that location).

FIG. 1A is a plot of this panning function as a function of the panning coefficient $\alpha$ in an embodiment in which $\beta=1-\alpha$. Notice that given the quadratic dependence on $\alpha$, the function $\psi(m,k)$ is multi-valued and symmetrical about 0.5. That is, if a source is panned say at $\alpha=0.2$, then the similarity function will have a value of $\psi=0.47$, but a source panned at $\alpha=0.8$ will have the same similarity value.

While this ambiguity might appear to be a disadvantage for source localization and segregation, it can easily be resolved using the difference between the partial similarity measures in (2). The difference is computed simply as $$D(m,k)=\psi_L(m,k)-\psi_R(m,k), \quad (3)$$

and we notice that time-frequency regions with positive values of D(m,k) correspond to signals panned to the left (i.e. $\alpha<0.5$), and negative values correspond to signals panned to the right (i.e. $\alpha>0.5$). Regions with zero value correspond to non-overlapping regions of signals panned to the center. Thus we can define an ambiguity-resolving function as $$D'(m,k)=1 \text{ if } D(m,k)>0 \tag{4}$$

and $$D'(m,k)=-1 \text{ if } D(m,k)<=0.$$

Multiplying the quantity one minus the similarity function by D'(m,k) we obtain a new metric, referred to herein as a panning index, which is anti-symmetrical and still bounded but whose values now vary from one to minus one as a function of the panning coefficient, i.e.

$$\Gamma(m,k)=[1-\psi(m,k)]D'(m,k), \tag{5}$$

Figure 1B:
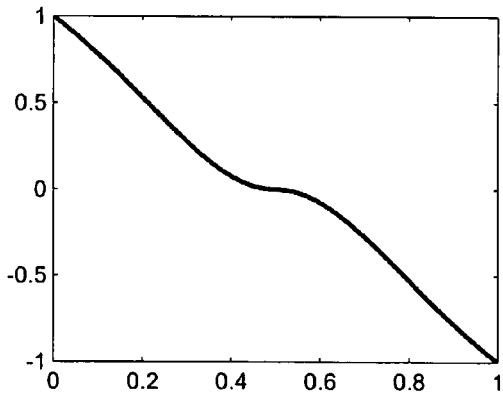
FIG. 1B is a plot of this panning index as a function of $\alpha$ in an embodiment in which $\beta=1-\alpha$.
Figure 1C:
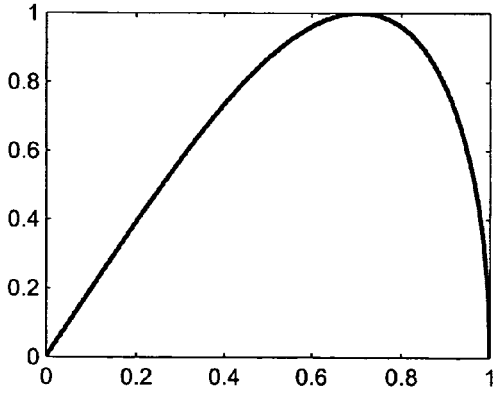
FIG. 1C is a plot of the panning function $\psi(m,k)$ as a function of $\alpha$ in an embodiment in which $\beta=(1-\alpha^2)^{1/2}$.
Figure 1D:
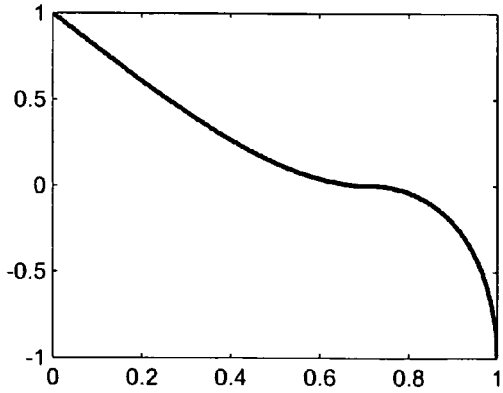
FIG. 1D is a plot of the panning index in (5) as a function of $\alpha$ in an embodiment in which $\beta=(1-\alpha^2)^{1/2}$.

FIG. 1B is a plot of this panning index as a function of $\alpha$ in an embodiment in which $\beta 1-\alpha$. FIG. 1C is a plot of the panning function $\psi(m,k)$ as a function of $\alpha$ in an embodiment in which $\beta=(1-\alpha^2)^{1/2}$. FIG. 1D is a plot of the panning index in (5) as a function of $\alpha$ in an embodiment in which $\beta=(1-\alpha^2)^{1/2}$.

In the following sections we describe the application of the short-time similarity and panning index to upmix, unmix, and source identification (localization). Notice that given a panning index we can obtain the corresponding panning coefficient given the one-to-one correspondence of the functions.

The above concepts and equations are applied in one embodiment to extract one or more audio streams comprising a panned source from a two-channel signal by selecting directions in the stereo image. As we discussed above, the panning index in (5) can be used to estimate the panning coefficient of an amplitude-panned signal. If multiple panned signals are present in the mix and if we assume that the signals do not overlap significantly in the time-frequency domain, then the panning index $\Gamma(m,k)$ will have different values in different time-frequency regions corresponding to the panning coefficients of the signals that dominate those regions. Thus, the signals can be separated by grouping the time-frequency regions where $\Gamma(m,k)$ has a given value and using these regions to synthesize time-domain signals.

Figure 2:
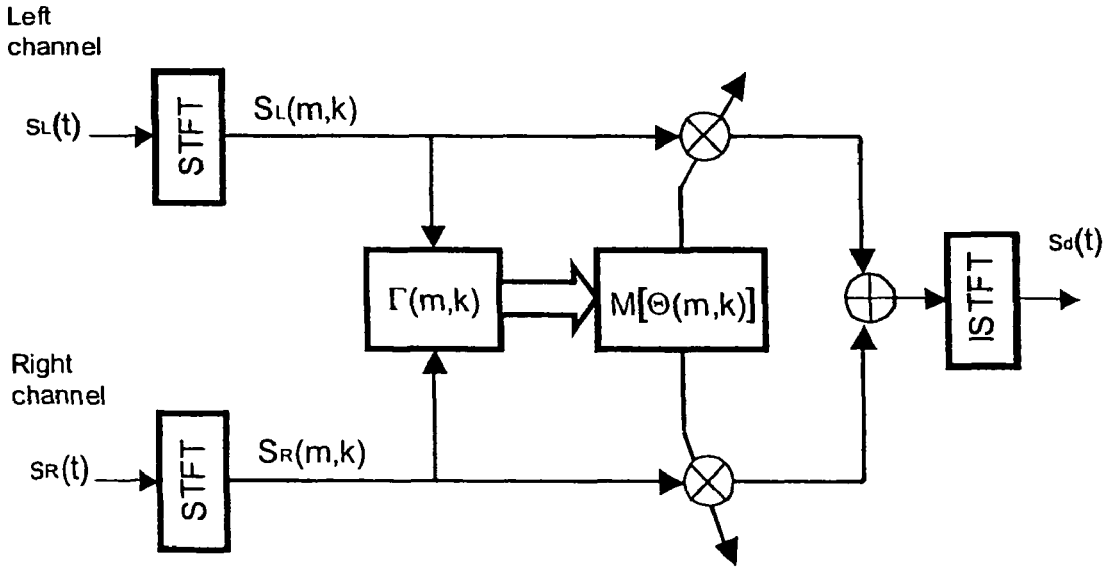
FIG. 2 is a block diagram illustrating a system used in one embodiment to extract from a stereo signal a signal panned in a particular direction.

FIG. 2 is a block diagram illustrating a system used in one embodiment to extract from a stereo signal a signal panned in a particular direction. For example, in one embodiment to extract the center-panned signal(s) we find all time-frequency regions for which the panning index $\Gamma(m,k)$ is zero and define a function $\Theta(m,k)$ that is one for all $\Gamma(m,k)=0$, and zero (or, in one embodiment, a small non-zero number, to avoid artifacts) otherwise. In one variation on this approach, we find all time-frequency regions for which the panning index $\Gamma(m,k)$ falls within a window centered on zero (e.g., all regions for which $-\epsilon\leqq\Gamma(m,k)\leqq\epsilon$) and define a function $\Theta(m,k)$ that is one for all regions having a panning index that falls in the window and zero (or, in one embodiment, a small non-zero number, to avoid artifacts) otherwise. In some alternative embodiments, the value of the function $\Theta(m,k)$ is one for all regions having a panning index equal to zero and a value less than and greater than or equal to zero for regions having a panning index that falls within the window, depending on the value, such that for panning index values close to zero (or the non-zero center of the window, for a window not centered on zero) the value of $\Theta(m,k)$ is close to one and for panning index values at the edges of the window (e.g., .$\Gamma(m,k)=\epsilon$ or $-\epsilon$) the value of $\Theta(m,k)$ is close to zero. We can then synthesize a time-domain function by multiplying $S_L(m,k)$ and $S_R(m,k)$ by a modification function $M[\Theta(m,k)]$ and applying the ISTFT. In one embodiment, the value of the modification function $M[\Theta(m,k)]$ is the same as the value of the function $\Theta(m,k)$. In one alternative embodiment, the value of the modification function $M[\Theta(m,k)]$ is not the same as the value of the function $\Theta(m,k)$ but is determined by the value of the function $\Theta(m,k)$. The same procedure can be applied to signals panned to other directions, with the function $\Theta(m,k)$ being defined to equal one when $\Gamma(m,k)$ is equal to the panning index value associated with the panned source (or a window centered on or otherwise comprising the panning index value associated with the source), and zero (or a small number) for all other values of $\Gamma(m,k)$. In one embodiment in which the function $\Theta(m,k)$ is defined to equal one when $\Gamma(m,k)$ is a panning index value that falls within a window of panning index values associated with the source, a user interface is provided to enable a user to provide an input to define the size of the window, such as by indicating the value of the window size variable $\epsilon$ in the inequality $-\epsilon\leqq\Gamma(m,k)\leqq\epsilon$.

In some embodiments, the width of the panning index window is determined based on the desired trade-off between separation and distortion (a wider window will produce smoother transitions but will allow signal components panned near zero to pass).

To illustrate the operation of the un-mixing algorithm we performed the following simulation. We generated a stereo mix by amplitude-panning three sources, a speech signal $S_1(t)$, an acoustic guitar $S_2(t)$ and a trumpet $S_3(t)$ with the following weights:

$$S_L(t)=0.5S_1(t)+0.7S_2(t)+0.1S_3(t) \text{ and } S_R(t)=0.5S_1(t)+0.3S_2(t)+0.9S_3(t).$$

We applied a window centered at $\Gamma=0$ to extract the center-panned signal, in this case the speech signal, and two windows at $\Gamma=-0.8$ and $\Gamma=0.27$ (corresponding to $\alpha=0.1$ and $\alpha=0.3$) to extract the horn and guitar signals respectively. In this case we know the panning coefficients of the signals that we wish to separate. This scenario corresponds to applications where we wish to extract or separate a signal at a given location.

Figure 3:
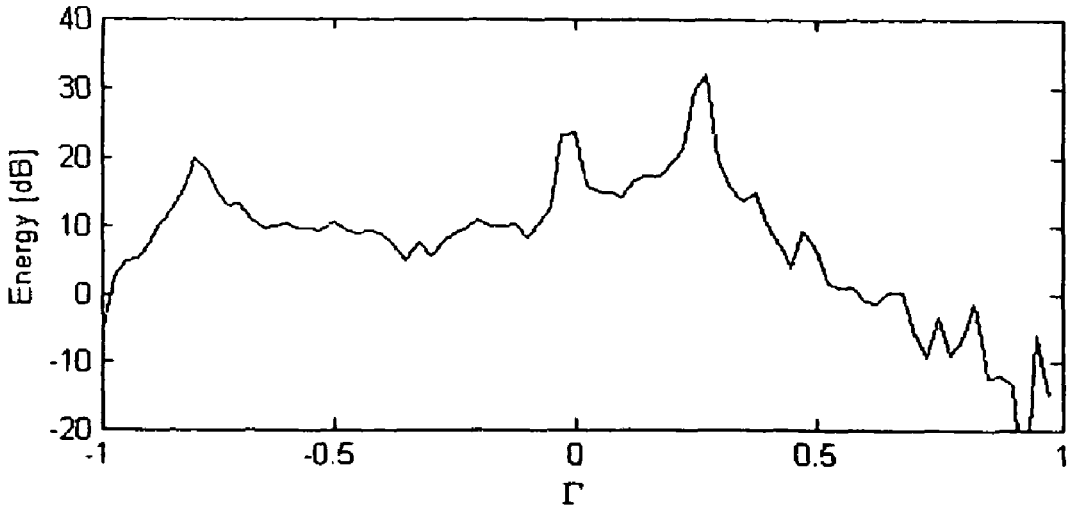
FIG. 3 is a plot of the average energy from an energy histogram over a period of time as a function of $\Gamma$ for the sample signal described above.

We now describe a method for identifying amplitude-panned sources in a stereo mix. In one embodiment, the process is to compute the short-time panning index $\Gamma(m,k)$ and produce an energy histogram by integrating the energy in time-frequency regions with the same (or similar) panning index value. This can be done in running time to detect the presence of a panned signal at a given time interval, or as an average over the duration of the signal. FIG. 3 is a plot of the average energy from an energy histogram over a period of time as a function of $\Gamma$ for the sample signal described above. The histogram was computed by integrating the energy in both stereo signals for each panning index value from $-1$ to 1 in 0.01 increments. Notice how the plot shows three very strong peaks at panning index values of $\Gamma=-0.8$, 0 and 0.275, which correspond to values of $\alpha=0.1$, 0.5 and 0.7 respectively.

Once the prominent sources are identified automatically from the peaks in the energy histogram, the techniques described above can be used extract and synthesize signals that consist primarily of the prominent sources, or if desired to extract and synthesize a particular source of interest.

2. Identification and Modification of a Panned Source

In the preceding section, we describe how a prominent panned source may be identified and segregated. In this section, we disclose applying the techniques described above to selectively modify portions of an audio signal associated with a panned source of interest.

Figure 4:
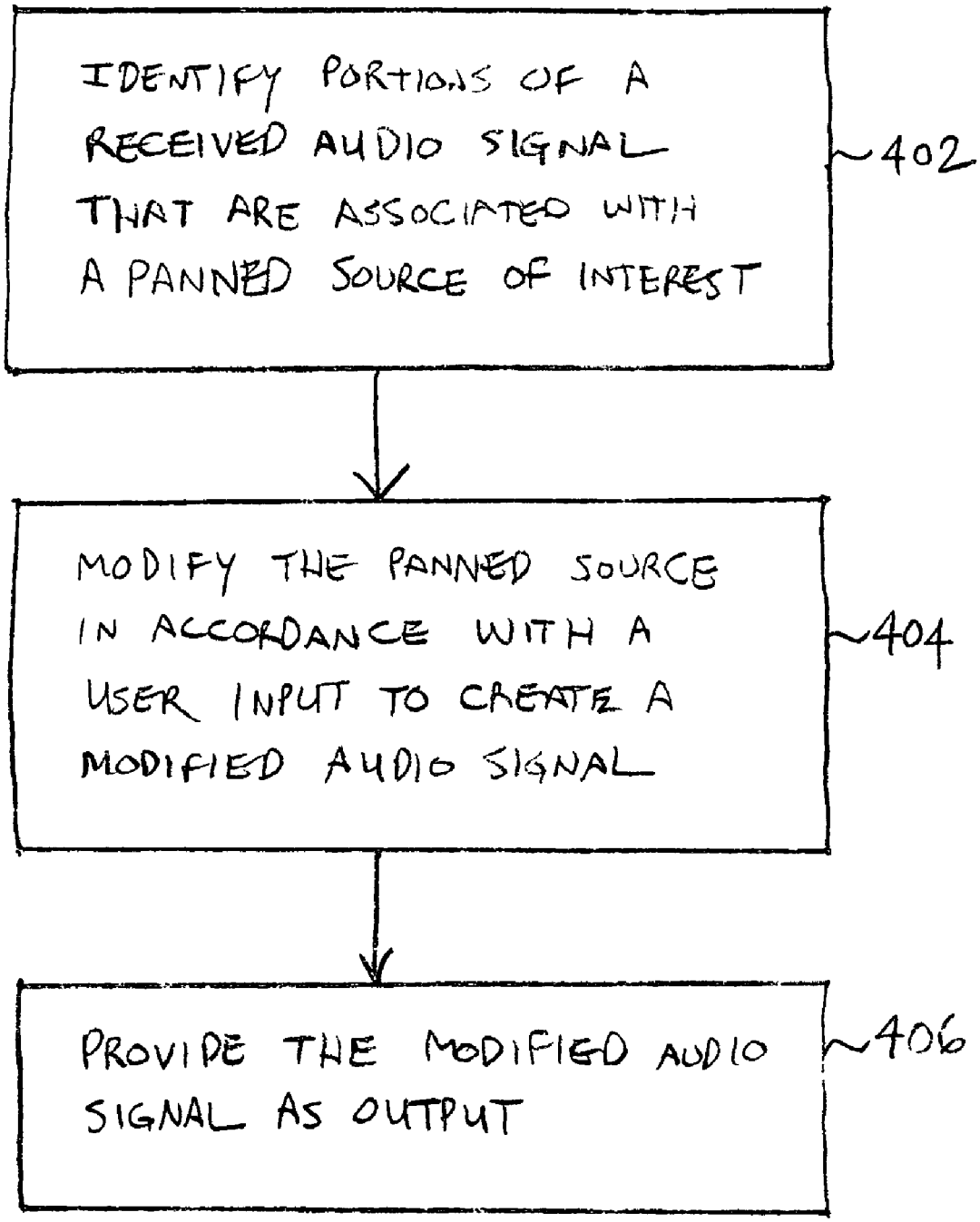
FIG. 4 is a flow chart illustrating a process used in one embodiment to identify and modify a panned source in an audio signal.

FIG. 4 is a flow chart illustrating a process used in one embodiment to identify and modify a panned source in an audio signal. The process begins in step 402, in which portions of the audio signal that are associated with a panned source of interest are identified. In one embodiment, the energy histogram approach described above in connection with FIG. 3 may be used to identify a panned source of interest. In one embodiment, the panning index (or coefficient) of the panned source of interest may be known, determined, or estimated based on knowledge regarding the audio signal and how it was created. For example, in one embodiment it may be assume that a featured vocal component has been panned to the center.

In step 404, the portions of the audio signal associated with the panned source are modified in accordance with a user input to create a modified audio signal. In one embodiment, the modification performed in step 404 is determined not by a user input but instead by one or more settings established in advance, such as by a sound designer. In one embodiment, the modified audio signal comprises a channel of an input audio signal in which portions associated with the panned source have been modified, e.g., enhanced or suppressed. The modified audio signal is provided as output in step 406.

Figure 5:
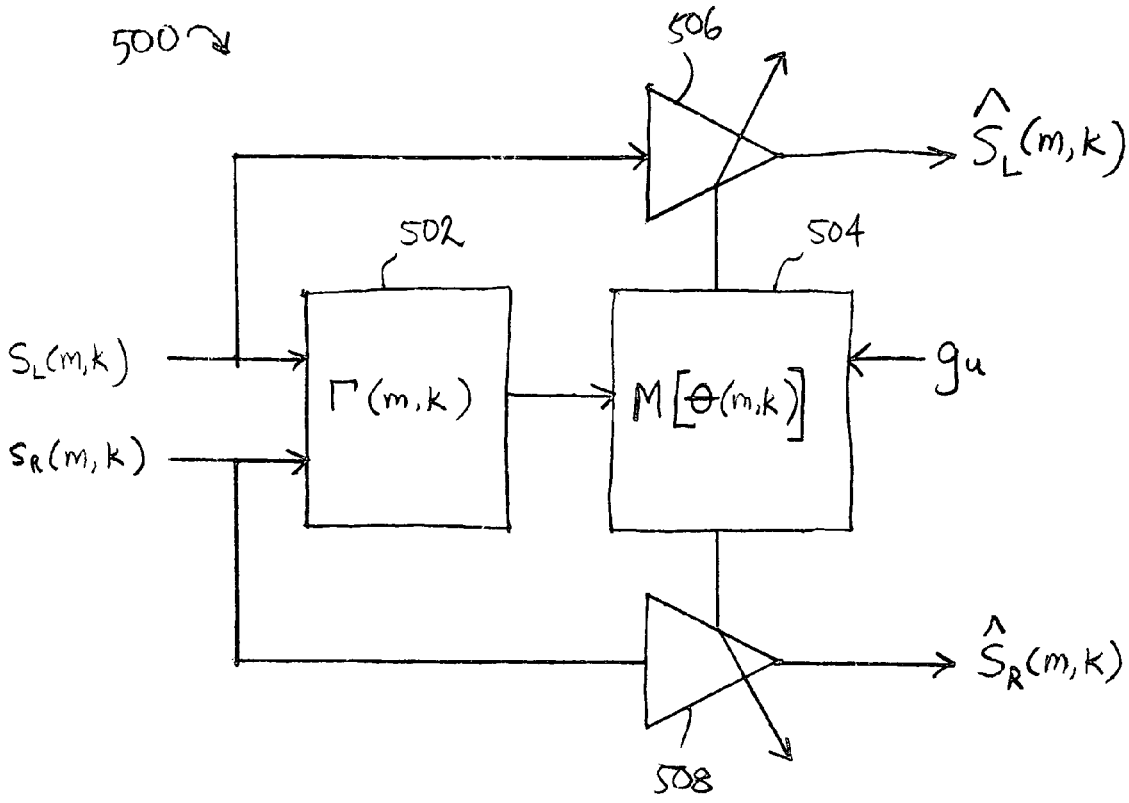
FIG. 5 is a block diagram of a system used in one embodiment to identify and modify a panned source in an audio signal.

FIG. 5 is a block diagram of a system used in one embodiment to identify and modify a panned source in an audio signal. The system 500 receives as input the signals $S_L(m,k)$ and $S_R(m,k)$, which correspond to the left and right channels of a received audio signal transformed into the time-frequency domain, as described above in connection with FIG. 2. The received signals $S_L(m,k)$ and $S_R(m,k)$ are provided as inputs to a panning index determination block 502, which generates panning index values for each time-frequency bin. The panning index values are provided as input to a modification function block 504, configured to generate modification function values to modify portions of the audio signal associated with a panned source of interest. In one embodiment, the modification function block 504 is configured to provide as output a value of one for portions of the audio signal not associated with the panned source, and a value for portions associated with the panned source that corresponds to the level of modification desired (e.g., greater than one for enhancement and less than one for suppression). In one embodiment, modification function block 504 is configured to receive a user-controlled input $g_u$. In one alternative embodiment, the value of the gain $g_u$ is determined not by a user input but instead in advance, such as by a sound designer.

In one embodiment, the input $g_u$ is used as a linear scaling factor and the modification function has a value of $g_u$ for portions of the audio signal associated with the panned source of interest. That is, if the function $\Theta(m,k)$ is defined as described above to equal one for time-frequency bins for which the panning index has a value associated with the panned source of interest and zero otherwise, in one embodiment the value of the modification function M is 1 for $\Theta(m,k)=0$ and $g_u$ for $\Theta(m,k)=1$. In one embodiment, the user-controlled input $g_u$ comprises or determines the value of a variable in a nonlinear modification function implemented by block 504. In one embodiment, the modification function block 504 is configured to receive a second user-controlled input (not shown in FIG. 5) identifying the panning index associated with the panned source to be modified. In one embodiment, the block 504 is configured to assume that the panned source of interest is center-panned (e.g., vocal), unless an input is received indicating otherwise. The output of modification function block 504 is provided as a gain input to each of a left channel amplifier 506 and a right channel amplifier 508. The amplifiers 506 and 508 receive as input the original time-frequency domain signals $S_L(m,k)$ and $S_R(m,k)$, respectively, and provide as output modified left and right channel signals $\hat{S}_L(m,k)$ and $\hat{S}_R(m,k)$, respectively. In one embodiment, the modification function block 504 is configured such that in the modified left and right channel signals $\hat{S}_L(m,k)$ and $\hat{S}_R(m,k)$ portions of the original input signals that are not associated with the panned source of interest are (largely) unmodified and portions associated with the panning index associated with the panned source of interest have been modified as indicated by the user.

Figure 6:
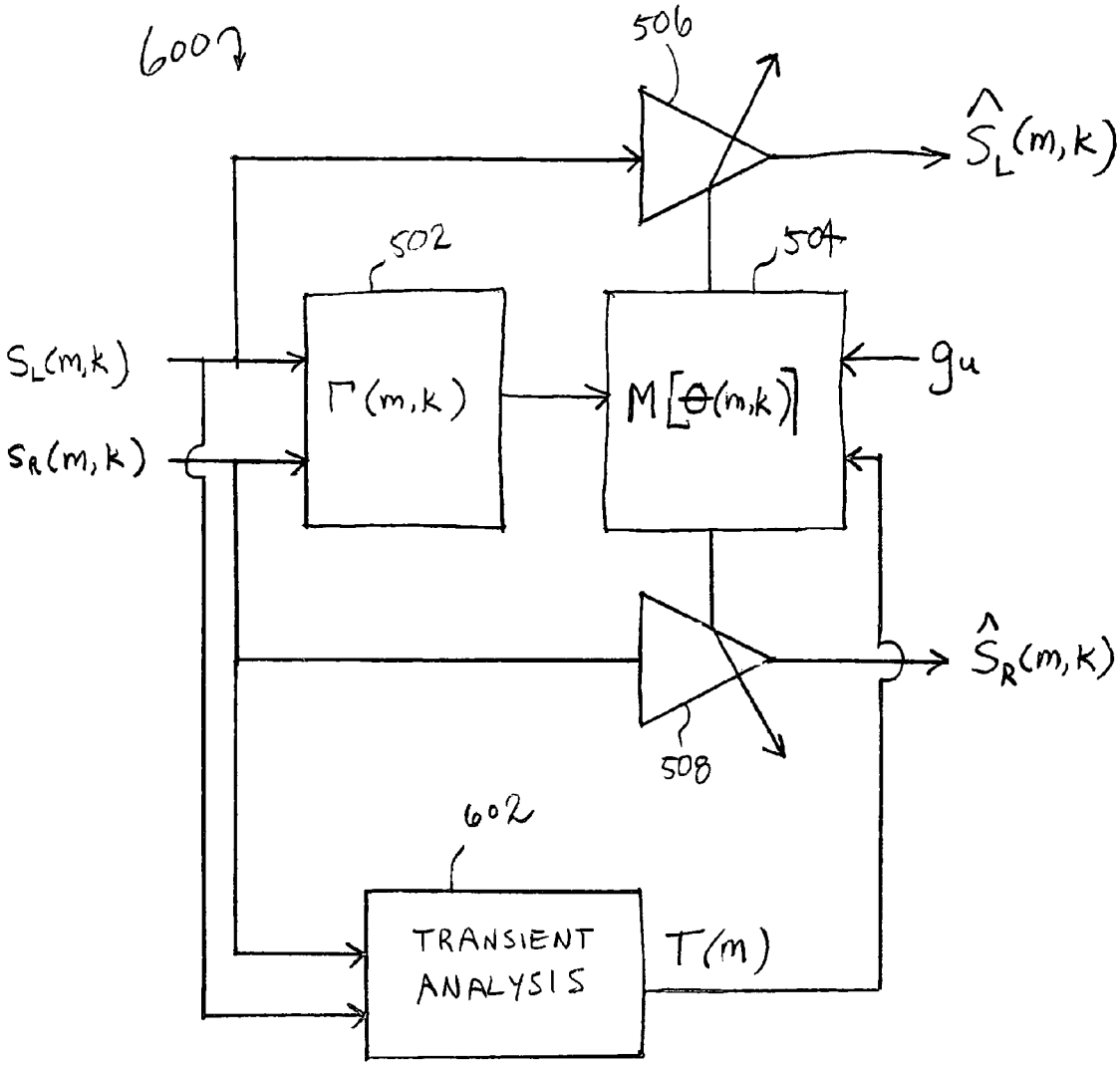
FIG. 6 is a block diagram of a system used in one embodiment to identify and modify a panned source in an audio signal, in which transient analysis has been incorporated.

FIG. 6 is a block diagram of a system used in one embodiment to identify and modify a panned source in an audio signal, in which transient analysis has been incorporated. As noted above, both vocal components and percussion-type instruments may be panned to the center in certain audio signals. Percussion instruments typically generate broadband, transient audio events in an audio signal. The system shown in FIG. 6 incorporates transient analysis to detect such transient events and avoid applying to associated portions of the audio signal a modification intended to modify a center-panned vocal component of the signal. The system 600 of FIG. 6 comprises the elements of the system 500 of FIG. 5, and in addition comprises a transient analysis block 602. The received audio signals $S_L(m,k)$ and $S_R(m,k)$ are provided as inputs to the transient analysis block 602, which determines for each frame "m" of the audio signal a corresponding transient parameter value T(m), the value of which is determined by whether (or, in one embodiment, the extent to which), a transient audio event is associated with the frame. In one embodiment, the transient parameters T(m) comprise a normalized spectral flux value determined by calculating the change in spectral content between frame m−1 and frame m. A technique for detecting transient audio events using spectral flux values is described more fully in U.S. patent application Ser. No. 10/606,196, entitled Transient Detection and Modification in Audio Signals, filed Jun. 24, 2003, now U.S. Pat. No. 7,353,169, which is incorporated herein by reference for all purposes.

The transient parameters T(m) are provided as an input to the modification function block 504. In one embodiment, if the value of the transient parameter T(m) is greater than a prescribed threshold, no modification is applied to the portions of the audio signal associated with that frame. In one embodiment, if the transient parameter exceeds the prescribed threshold, the modification function value for all portions of the signal associated with that frame is set to one, and no portion of that frame is modified. In one alternative embodiment, the degree of modification of portions of the audio signal associated with the panning direction of interest varies linearly with the value of the transient parameter T(m). In one such embodiment, the value of the modification function M is 1 for portions of the audio signal not associated with the panned source of interest and $M=1+g_u(1-T(m))$ for portions of the audio signal associated with the panned source of interest, with T(m) having a value between zero (no transient detected) and one (significant transient event detected, e.g., high spectral flux) and the user-defined parameter $g_u$ having a positive value for enhancement and a negative value between minus one (or nearly minus one) and zero for suppression. In one alternative embodiment, the valued of the modification function M varies nonlinearly as a function of the value of the transient parameter T(m).

3. Extraction and Modification of a Panned Source

In this section we describe extraction and modification of a panned source. In one embodiment, a panned source, such as a center-panned source, may be extracted and modified as taught herein, and then provided as a signal to a channel of a multichannel playback system, such as the center channel of a surround sound system.

Figure 7:
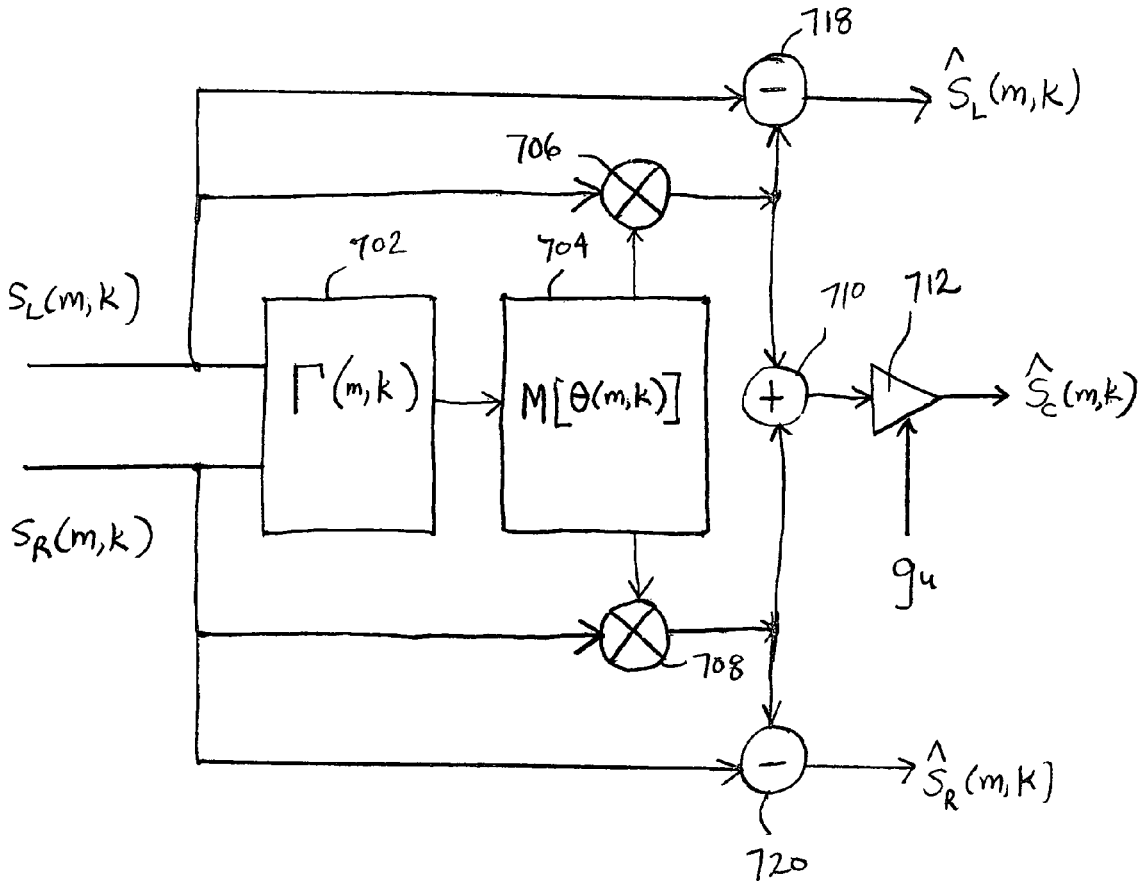
FIG. 7 is a block diagram of a system used in one embodiment to extract and modify a panned source.

FIG. 7 is a block diagram of a system used in one embodiment to extract and modify a panned source. The system 700 receives as input the signals $S_L(m,k)$ and $S_R(m,k)$, which correspond to the left and right channels of a received audio signal transformed into the time-frequency domain, as described above in connection with FIG. 2. The received signals $S_L(m,k)$ and $S_R(m,k)$ are provided as inputs to a panning index determination block 702, which generates panning index values for each time-frequency bin. The panning index values are provided as input to a modification function block 704, configured to generate modification function values to extract portions of the audio signal associated with a panned source of interest. In one embodiment, the modification function block 704 is configured to provide as output a value of one for portions of the audio signal associated with the panned source to be extracted, and a value of zero (or nearly zero) otherwise. In one alternative embodiment, the modification function block 704 may be configured to provide as output for portions of the audio signal having a panning index near that associated with the panned source a value between zero and one for purposes of smoothing. The modification function values are provided as inputs to left and right channel multipliers 706 and 708, respectively. The output of the left channel multiplier 706 (comprising portions of the left channel signal $S_L(m,k)$ that are associated with the panned source being extracted) and the output of the right channel multiplier 708 (comprising portions of the right channel signal $S_R(m,k)$ that are associated with the panned source being extracted) are provided as inputs to a summation block 710, the output of which comprises the extracted, unmodified portion of the input audio signal that is associated with the panned source of interest. The elements of FIG. 7 described to this point are the same in one embodiment as the corresponding elements of FIG. 2. The output of summation block 710 is provided as the signal input to a modification block 712, which in one embodiment comprises a variable gain amplifier. The modification block 712 is configured to receive a user-controlled input $g_u$, the value of which in one embodiment is set by a user via a user interface to indicate a desired level of modification (e.g., enhancement or suppression) of the extracted panned source. In one embodiment, a gain of $g_u$ multiplied by the square root of 2 is applied by the modification block 712 for energy conservation. The extracted and modified panned source is provided as output by the modification block 712. In one embodiment, as shown in FIG. 7, the extracted and modified panned source is provided as the signal to an upmix channel, such as the center channel of a multichannel playback system. In one embodiment, as shown in FIG. 7, the respective center-panned components extracted from the left channel and right channel signals are subtracted from the original left and right channel signals by operation of subtraction blocks 718 and 720, respectively, to generate modified left and right channel signals $\hat{S}_L(m,k)$ and $\hat{S}_R(m,k)$, from which the extracted center-panned components have been removed.

Figure 8:
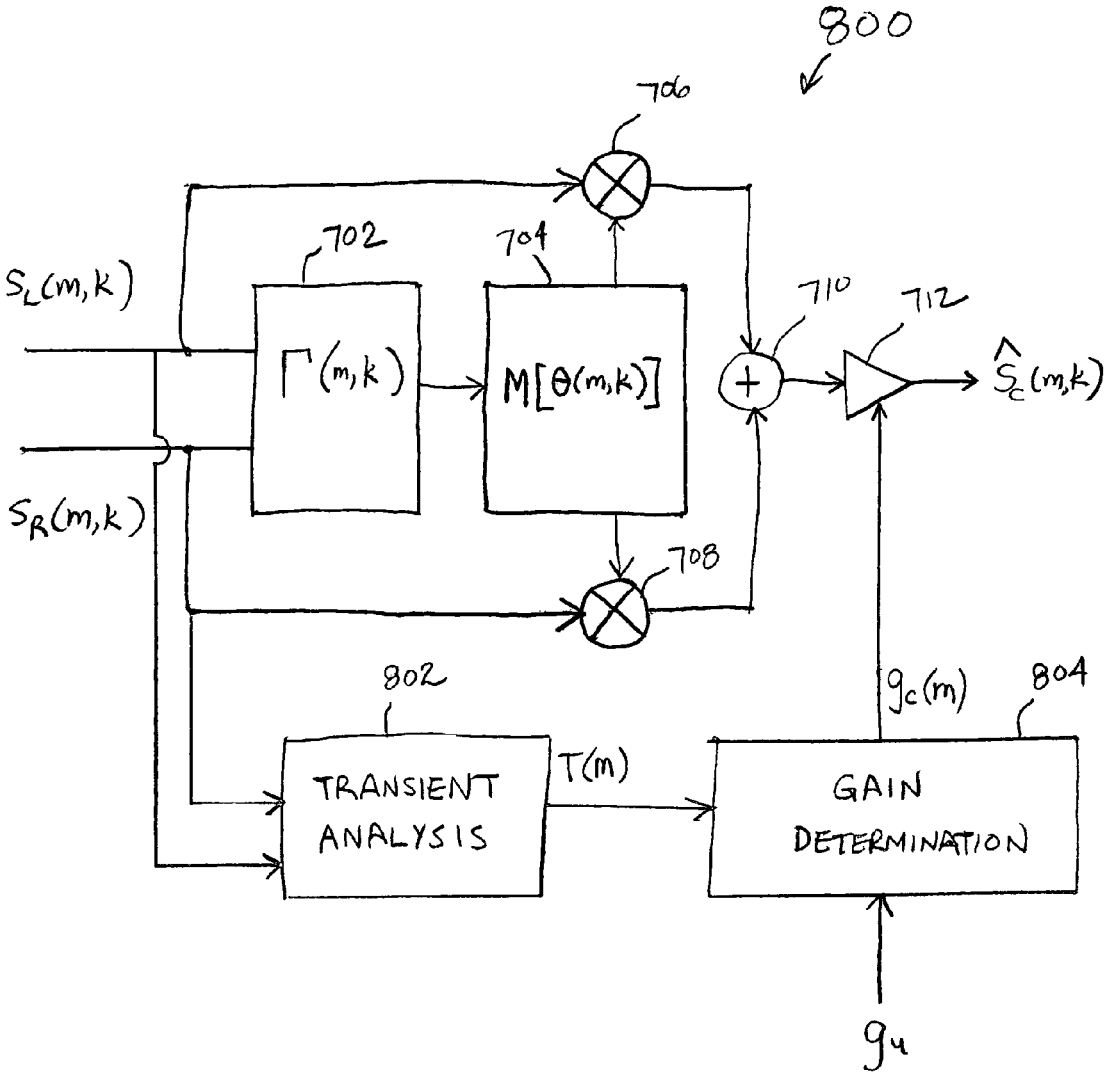
FIG. 8 is a block diagram of a system used in one embodiment to extract and modify a panned source, in which transient analysis has been incorporated.

FIG. 8 is a block diagram of a system used in one embodiment to extract and modify a panned source, in which transient analysis has been incorporated. The system 800 comprises the elements of system 700 of FIG. 7, modified as shown in FIG. 8 and not showing for purposes of clarity the components associated with subtracting the extracted center-panned components from the left and right channel signals as described above, and in addition comprises a transient analysis block 802. In one embodiment, the transient analysis block 802 operates similarly to the transient analysis block 602 of FIG. 6. The transient analysis block 802 provides as output for each frame k of audio data a transient parameter T(m), which is provided as an input to a gain determination block 804. The user-controlled input $g_u$, described above in connection with FIG. 7, also is supplied as an input to the gain determination block 804. The gain determination block 804 is configured to use these inputs to determine for each frame a gain $g_c(m)$, which is provided as the gain input to modification block 712. In one embodiment, the gain $g_c(m)$ equals the user-controlled input $g_u$ if the transient parameter T(m) is below a prescribed threshold (i.e., full modification because no transient is detected) and $g_c(m)=1$ if the transient parameter T(m) is greater than the prescribed threshold (i.e., no modification, because a transient has been detected). In one alternative embodiment, some degree of modification may be applied even if a transient has been detected. In one embodiment, as described above, the degree of modification may vary either linearly or nonlinearly as a function of T(m). For example, in one embodiment the gain gam) may be determined by the equation $g_c(m)=1+g_u(1-T(m))$, where T(m) is normalized to range in value between zero (no transient) and one (significant transient), and $g_u$, has a positive value for enhancement and a negative value between minus one (or nearly minus one) and zero for suppression.

Figure 9A:
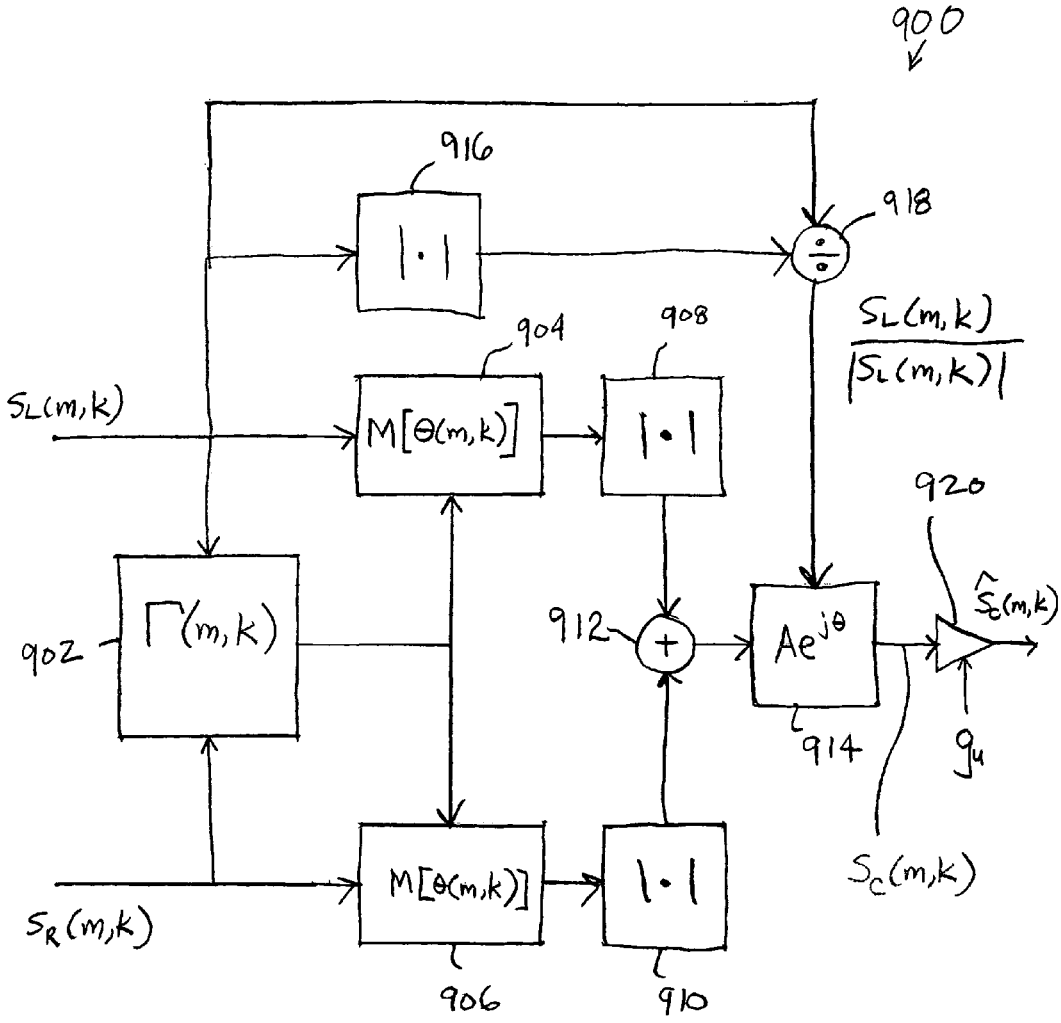
FIG. 9A is a block diagram of an alternative system used in one embodiment to extract and modify a panned source.
Figure 9B:
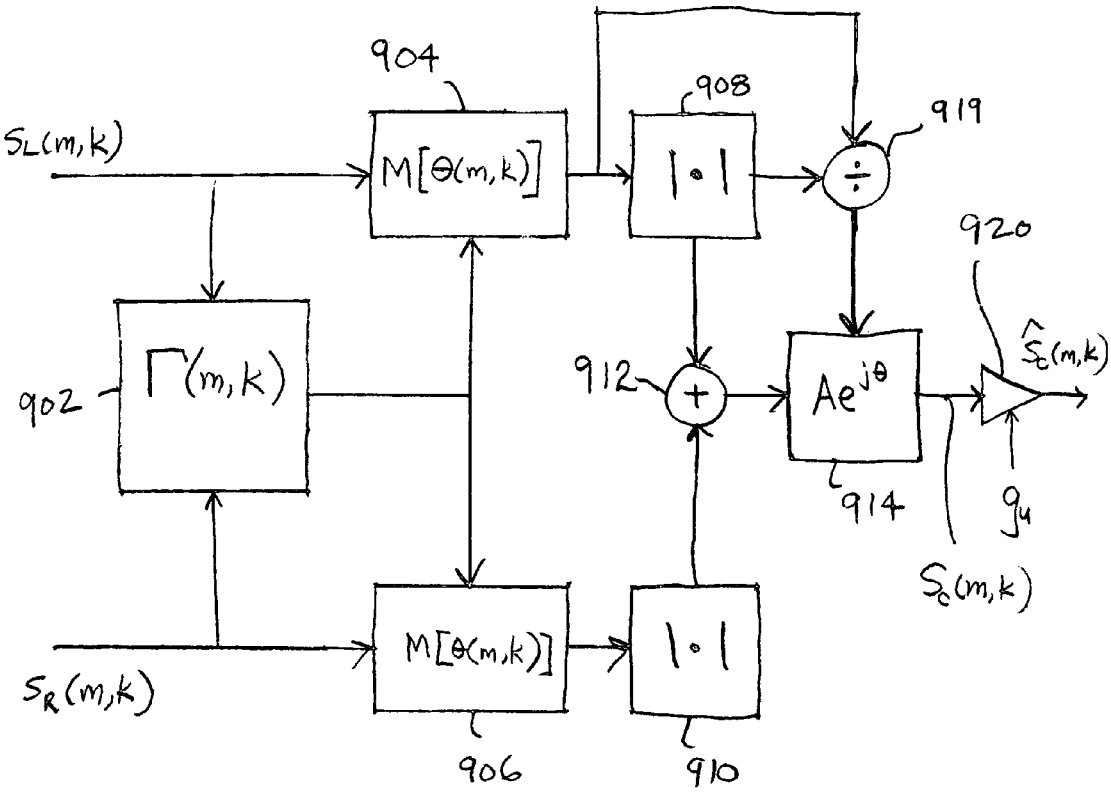
FIG. 9B illustrates an alternative and computationally more efficient approach for extracting the phase information in a system such as system 900 of FIG. 9A.

FIG. 9A is a block diagram of an alternative system used in one embodiment to extract and modify a panned source. In one embodiment, the system 900 of FIG. 9A may produce a modified signal having fewer artifacts than the system 700 of FIG. 7, by extracting and combining only the magnitude component of portions of the audio signal associated with the panned source of interest and then applying the phase of one of the input channels to the extracted panned source. In one embodiment, such co-phasing is useful for the reduction of audible artifacts when previous processing, e.g., previous modifications, of the audio signal have altered the phase relationships between corresponding components of the signal. The system 900 receives as input the signals $S_L(m,k)$ and $S_R(m,k)$, which correspond to the left and right channels of a received audio signal transformed into the time-frequency domain, as described above in connection with FIG. 2. The received signals $S_L(m,k)$ and $S_R(m,k)$ are provided as inputs to a panning index determination block 902, which generates panning index values for each time-frequency bin. The panning index values are provided as input to a left channel modification function block 904 and a right channel modification function block 906, configured to generate modification function values to extract portions of the audio signal associated with a panned source of interest. In one embodiment, the modification function of blocks 904 and 906 operates similarly to the corresponding blocks 504 of FIGS. 5 and 704 of FIG. 7. In one embodiment, the modification function of blocks 904 and 906 is real-valued and does not affect phase. The outputs of the modification function blocks 904 and 906 are provided to left channel extracted signal magnitude determination block 908 and right channel extracted signal magnitude determination block 910, respectively, which are configured to determine the magnitude of the respective extracted signals. The magnitude values are provided by blocks 908 and 910 to a summation block 912, which combines the magnitudes. The combined magnitude values are provided to a magnitude-phase combination block 914, which applies the phase of one of the input channels to the combined magnitude values. In the example shown in FIG. 9, the phase of the left input channel is used; but the right channel could as well have been used. In FIG. 9A, the phase information of the left channel is extracted by processing the left channel signal using a left channel input signal magnitude determination block 916 and dividing the left channel input signal by the left channel input signal magnitude values in a division block 918. The resultant phase information is provided as an input to the magnitude-phase combination block 914. FIG. 9B illustrates an alternative and computationally more efficient approach for extracting the phase information in a system such as system 900 of FIG. 9A. As shown in FIG. 9B, the output of the left channel modification function block 904 and the output of the left channel magnitude determination block 908 may be provided as inputs to a division block 919, and the result provided as the extracted phase input to magnitude-phase combination block 914. In such an alternative embodiment, the block 916 and the line supplying the left channel signal to the phase extraction (division) block 918 of FIG. 9A may be omitted. The output of the magnitude-phase combination block 914 is provided to a modification block 920 configured to apply a user-controlled modification to the extracted signal. FIG. 9A shows a user-controlled gain input $g_u$, such as described above, being provided as an input to the block 920. In other embodiments other inputs, including the transient analysis information described above, may also be provided to block 920 or determine the value of one or more inputs to block 920. The output of modification block 920 is provided in the example shown in FIG. 9A as an extracted and modified center channel signal $\hat{S}_c(m,k)$.

Figure 10:
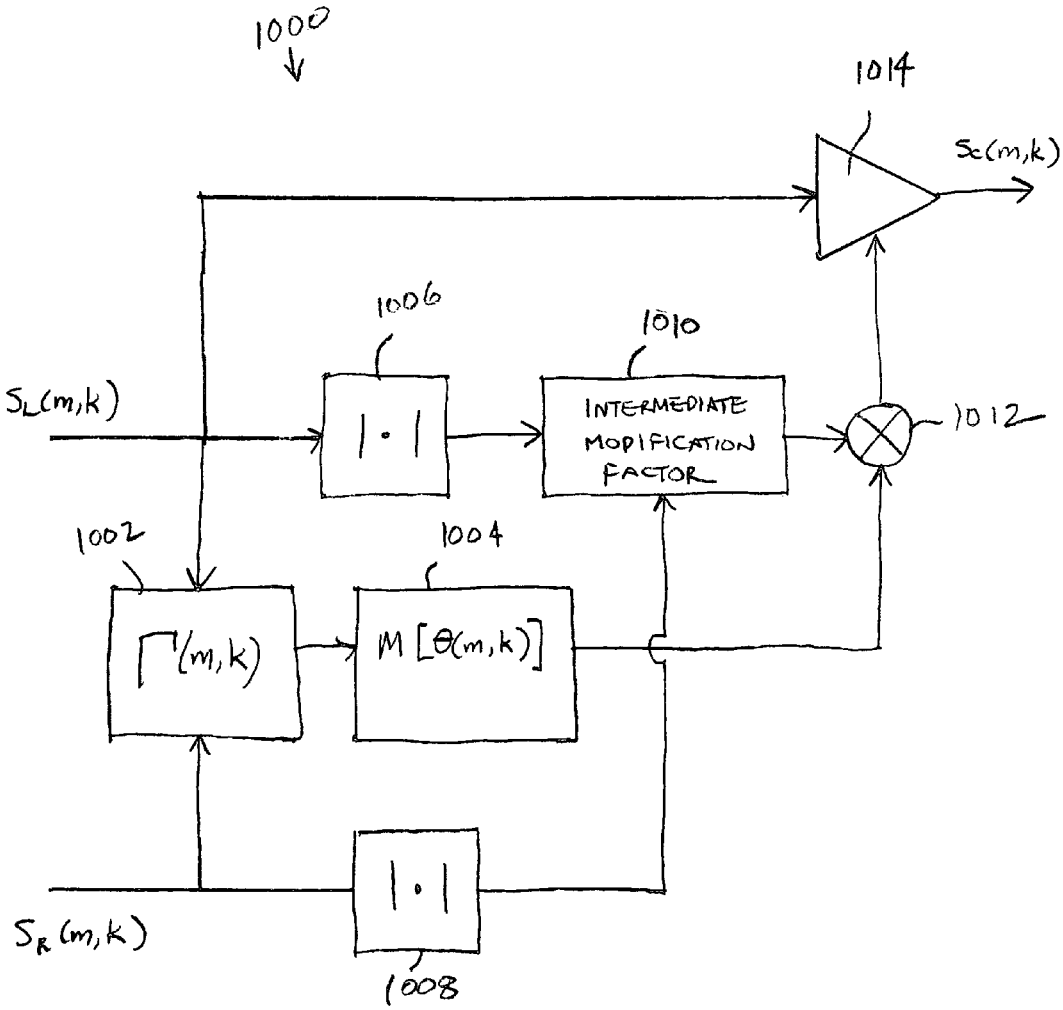
FIG. 10 is a block diagram of a system used in one embodiment to extract and modify a panned source using a simplified implementation of the approach used in the system 900 of FIG. 9A.

FIG. 10 is a block diagram of a system used in one embodiment to extract and modify a panned source using a simplified implementation of the approach used in the system 900 of FIG. 9A. The implementation shown in FIG. 10 is based on the following mathematical analysis of the relationships reflected in FIG. 9A. Specifically, the output of the magnitude-phase combination block 914 may be represented as follows:

$$(|S_L(m,k)M[\Theta(m,k)]| + |S_R(m,k)M[\Theta(m,k)]|)\frac{S_L(m,k)}{|S_L(m,k)|} = S_C(m,k) \tag{6a}$$

Equation (6a) simplifies to $$M[\Theta(m,k)](|S_L(m,k)| + |S_R(m,k)|)\frac{S_L(m,k)}{|S_L(m,k)|} = S_C(m,k) \tag{6b}$$

which simplifies further to $$M[\Theta(m,k)]\left(1 + \frac{|S_R(m,k)|}{|S_L(m,k)|}\right)S_L(m,k) = S_C(m,k). \tag{6c}$$

The corresponding relationship for applying the right-channel phase, instead of the left-channel phase would be:

$$M[\Theta(m,k)]\left(1 + \frac{|S_L(m,k)|}{|S_R(m,k)|}\right)S_R(m,k) = S_C(m,k) \tag{6d}$$

The system of FIG. 10 is configured to apply the left input channel phase to the extracted signal, as shown in Equation (6c). The system 1000 receives as input the signals $S_L(m,k)$ and $S_R(m,k)$, which correspond to the left and right channels of a received audio signal transformed into the time-frequency domain, as described above in connection with FIG. 2. The received signals $S_L(m,k)$ and $S_R(m,k)$ are provided as inputs to a panning index determination block 1002, which generates panning index values for each time-frequency bin. The panning index values are provided as input to a modification function block 1004, configured to generate modification function values to extract portions of the audio signal associated with a panned source of interest, as described above. The magnitude of the left channel input signal is determined by left channel magnitude determination block 1006, and the magnitude of the right channel input signal is determined by right channel magnitude determination block 1008. The left and right channel magnitude values are provided to an intermediate modification factor determination block 1010, which is configured to calculate an intermediate modification factor equal to the portion of equation (6c) that appears above in parentheses:

$$1 + \frac{|S_L(m,k)|}{|S_R(m,k)|} \tag{6e}$$

The modification function values provided by block 1004 are multiplied by the intermediate modification factor values provided by block 1010 in a multiplication block 1012, which corresponds to the first part of Equation (6c). The results are provided as an input to a final extraction block 1014, which multiplies the results by the original left channel input signal to generate the extracted (as yet unmodified) center channel signal $S_c(m,k)$, in accordance with the final part of Equation (6c). The extracted center channel signal $S_c(m,k)$ may then be modified, as desired, using elements not shown in FIG. 10, such as the modification block 920 of FIG. 9, to generate a modified extracted center channel signal $\hat{S}_c(m,k)$.

Figure 11:
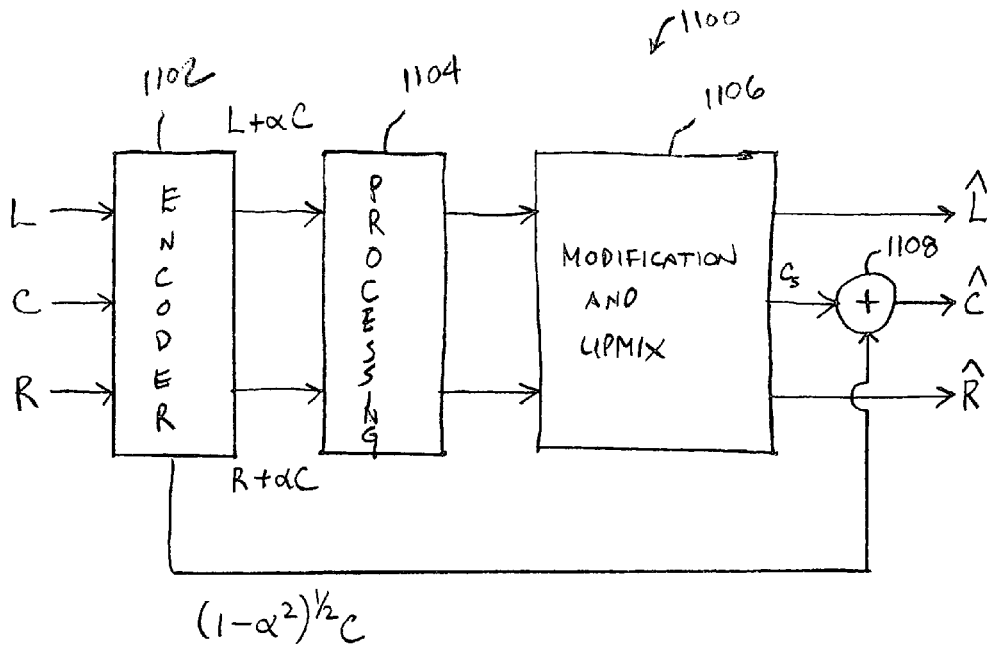
FIG. 11 is a block diagram of a system used in one embodiment to extract and modify a panned source for enhancement of a multichannel audio signal.

4. Extracting and Modifying a Panned Source for Enhancement of a Multichannel Audio Signal FIG. 11 is a block diagram of a system used in one embodiment to extract and modify a panned source for enhancement of a multichannel audio signal. The approach illustrated in FIG. 11 may be particularly useful in implementations in which multiple independent modules are used to process a multichannel (e.g., stereo, three channel, five channel) audio signal. The approach conserves resources by encoding at least part of one of the received channels into one or more other channels, and then processing only such other channels, thereby conserving the resources that would otherwise have been needed to also process the channel(s) so encoded.

The system 1100 of FIG. 11 receives as input an audio signal comprising three channels: a left channel L, a right channel R, and a center channel C. The three channels are provided as input to a center-channel encoder 1102, configured to encode at least part of the center channel C into the left channel L and right channel R, so that the center channel information so encoded will be processed by the processing modules that will operate subsequently on the left and right channel signals. In the example shown in FIG. 11, an encoding factor $\alpha$ is used to encode part of the center channel information into the left and right channels. In one embodiment, the output of the encoder 1102 comprises a center-encoded left channel signal $L+\alpha C$ and a center-encoded right channel signal $R+\alpha C$. In one embodiment, the center-encoded portions of the center-encoded left and right channel signals are the same and therefore are in essence center-panned components. The output of the encoder 1102 further comprises an energy-conserving residual center channel signal $(1-\alpha^2)^{1/2}$ C. In other embodiments, weights other than $(1-\alpha^2)^{1/2}$ are applied to provide the residual center channel signal. The center-encoded left channel signal $L+\alpha C$ and the center-encoded right channel signal R+α C are provided as left and right channel inputs to a block 1104 of processing modules, configured to perform one or more stages of digital signal processing on the center-encoded left and right channels. In one embodiment, the processing performed by module 1104 may comprise one or more of the processing techniques described in the U.S. patent applications incorporated herein by reference above, including without limitation transient detection and modification, enhancement by nonlinear spectral operations, and/or ambience identification and modification. The modified center-encoded left and right channel signals provided as output by processing block 1104 are provided as inputs to the modification and upmix module 1106, which is configured to provide as output a further modified left and right channel signal, as well as an extracted and modified center channel signal Cs. In one embodiment, the extracted and modified center channel signal Cs may comprise a signal extracted from the left and right channel signals and modified as described hereinabove in connection with FIGS. 5, 7, 9, and 10. In one embodiment, the signal portions extracted and modified by processing module 1106 may comprise the center-panned portions of those signals, which in one embodiment in turn may comprise the center-encoded portions added to the left and right input channels by the encoder 1102. In one embodiment, the extracted and modified center channel signal Cs is subtracted from the modified left and right channel signals to create further modified left and right channel signals from which the center channel components have been removed. The extracted and modified center channel signal Cs is combined with the energy-conserving residual center channel signal $(1-\alpha^2)^{1/2}$ C by a summation block 1108, the output of which is provided to the center channel of the playback system as a modified center channel signal. In one embodiment, encoding at least part of the center channel of the received audio signal into the left and right channels as described above results in user-desired processing being performed at least to some extent on the center channel information, without requiring that all of the processing modules in the system be configured to process the additional channel.

Figure 12:
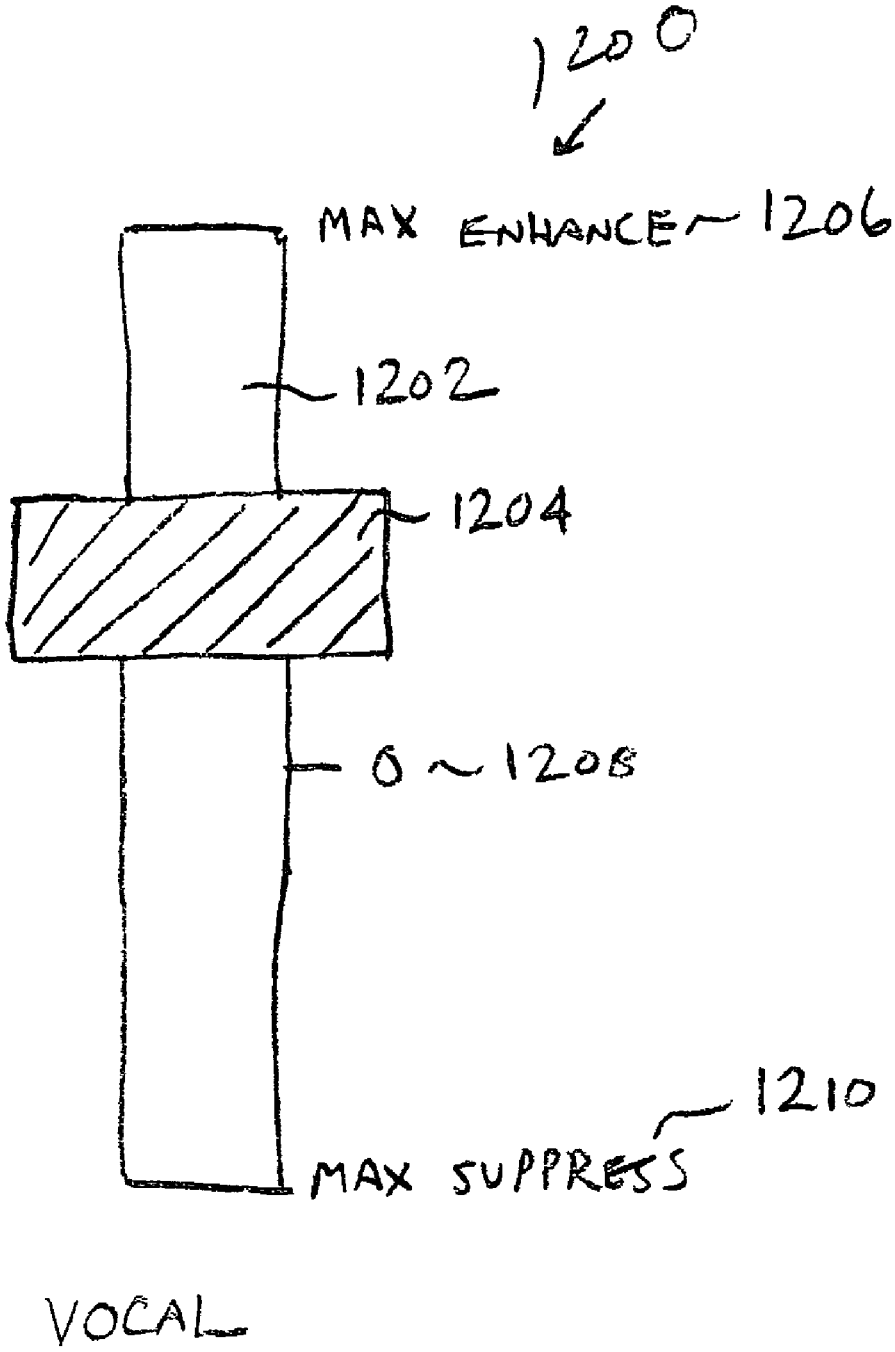
FIG. 12 illustrates a user interface provided in one embodiment to enable a user to indicate a desired level of modification of a panned source.

FIG. 12 illustrates a user interface provided in one embodiment to enable a user to indicate a desired level of modification of a panned source. In the example shown in FIG. 12, the control 1200 comprises a vocal component modification slider 1202 and a vocal component modification level indicator 1204. The slider 1202 comprises a null (or zero modification) position 1208, a maximum enhancement position 1206, and a maximum suppression position 1210. In one embodiment, the position of level indicator 1204 maps to a value for the user-controlled gain $g_u$, described above in connection with various embodiments, including FIGS. 5, 7, 9, and 10. In one alternative embodiment, a control similar to control 1200 may be provided to enable a user to indicate a desired level of modification to a panned source other than a center-panned vocal component. In one such embodiment, an additional user control is provided to enable a user to select the panned source to be modified as indicated by the level control, such as by specifying a panning index or coefficient, either by selecting or inputting a value or, in one embodiment, by selecting an option from among a set of options identified as described above in connection with FIG. 3.

While the embodiments described in detail herein may refer to or comprise a specific channel or channels, those of ordinary skill in the art will recognize that other, additional, and/or different input and/or output channels may be used. In addition, while in some embodiments described in detail a particular approach may be used to modify an identified and/or extracted panned source, many other modifications may be made and all such modifications are within the scope of this disclosure.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

What is claimed is:

1. A method for modifying with a system a panned source in an audio signal comprising a plurality of channel signals, the method comprising:

identifying in at least selected ones of said channel signals portions associated with the panned source;

extracting the portions associated with the panned source from at least one of the input channel signals;

determining the magnitude of the extracted portions;

combining the magnitude values for corresponding extracted portions from each of the input channel signals;

applying the phase of one of the input channel signals to the combined magnitudes; and modifying said portions associated with the panned source.

2. The method as recited in claim 1, further comprising providing said modified portions associated with the panned source to one or more selected playback channels of a multichannel playback system.

3. The method as recited in claim 1 wherein modifying said portions comprises decreasing or increasing the magnitude of said portions associated with the panned source by an arbitrary amount such that the panned source may still be heard in the modified audio signal as rendered but at a different level than in the original unmodified audio signal.

4. The method of claim 3, wherein said arbitrary amount is determined at least in part by a user input.

5. The method of claim 3, wherein said arbitrary amount is set in advance and may not be changed by a subsequent user of a system configured to implement said method.

6. A system for modifying a panned source in an audio signal having a plurality of channel signals, the system comprising:

an input connection configured to receive the audio signal; and a processor configured to:

identify in at least selected ones of said channel signals portions associated with the panned source;

extract the portions associated with the panned source from at least one of the input channel signals;

determine the magnitude of the extracted portions;

combine the magnitude values for corresponding extracted portions from each of the input channel signals;

apply the phase of one of the input channel signals to the combined magnitudes; and modify said portions associated with the panned source.

7. A method of processing with a system spatial information in an audio input signal including at least a first and a second input channel, comprising:

transforming the first and second input channel signals into a frequency domain representation including a frequency index;

for each frequency index, deriving a position in space representing a sound localization of a panned source;

identifying at least one signal portion associated with the panned source in at least one of the input channel signals;

extracting the portions associated with the panned source from at least one of the input channel signals;

determining the magnitude of the extracted portions;

combining the magnitude values for corresponding extracted portions from each of the input channel signals; and applying the phase of one of the input channel signals to the combined magnitudes.

8. The method as recited in claim 7 further comprising modifying the portions associated with the panned source.

9. The method of claim 7, wherein the frequency domain representation is provided by a subband filter bank.

10. The method of claim 7, wherein the frequency domain representation is derived by computing the short-time Fourier transform for the input channel signals.

11. The method of claim 8, wherein deriving a position in space comprises deriving one of a panning coefficient via a panning index associated with the panned source, the panning index being anti-symmetrical.

12. The method of claim 11, wherein identifying at least one signal portion associated with the panned source comprises identifying portions of the input channels that have a panning index that falls within a window of panning index values corresponding to the panned source.

13. The method of claim 12, wherein modifying the portions associated with the panned source comprises applying a modification function whose value is determined for each portion at least in part by the location of the panning index for that portion within the window of panning index values.

14. The method of claim 11, wherein the panning index is bounded and has a value within a first range of values for sources panned to the left and a value within a second range of values for sources panned to the right, wherein the first range of values and second range of values do not overlap.

15. The method of claim 8, wherein the step of modifying comprises applying a predefined modification function to said portions associated with the panned source when a user input indicates that the predefined modification should be applied.

16. The method of claim 15, wherein the user input comprises a gain by which the portions associated with the panned source are multiplied.

17. The method of claim 8, further comprising performing transient analysis to determine the extent to which said portions associated with the panned source are associated with a transient audio event.

18. The method of claim 17, wherein the step of modifying comprises applying to said portions associated with the panned source a modification determined at least in part by the extent to which said portions associated with the panned source are associated with a transient audio event.

19. The method of claim 8, further comprising providing as output a modified audio signal comprising the modified portions associated with the panned source.

20. The method of claim 19, further comprising processing said channel signals using a subband filter bank prior to identifying and modifying said portions associated with the panned source, and wherein said step of providing as output comprises synthesizing a modified time-domain signal.

21. The method of claim 20, wherein processing said channel signals using a subband filter bank comprises computing the short-time Fourier transform for said channel signals and synthesizing a modified time-domain signal comprises performing the inverse short-time Fourier transform.

22. The method of claim 8, further comprising providing the modified portions associated with the panned source to a selected playback channel of a multichannel playback system.

23. The method of claim 11, wherein the audio input signal comprises at least one panned source signal having a source panning index; and identifying the signal portion associated with the panned source includes selecting frequency indices where the derived panning index substantially matches the source panning index.

24. The method of claim 23, further comprising providing the modified portions associated with the panned source to a playback channel of a multichannel playback system, wherein the source panning index matches the location of the playback channel.

25. The method of claim 24, wherein the selected playback channel comprises a center channel and the panned source comprises a center-panned source.

26. The method of claim 7 further comprising associating a first source position in listening space with the first input channel and a second source position in listening space with the second input channel.

27. The method of claim 26, wherein the first and second input channel signals are intended for reproduction using a first and second loudspeaker at the first and second source positions, respectively.

28. The method of claim 7, wherein deriving the position in space includes deriving an inter-channel amplitude difference at each frequency.

29. The method of claim 26, wherein the first and second source positions are a left and a right position, respectively, in front of a listener.

30. The method as recited in claim 8 further comprising subtracting the portions associated with the panned source from the at least one input channel signals.

31. The method as recited in claim 23 further comprising processing or transmitting the audio input signal while preserving the panning position of the panned source signal.

* * * * *